US008550283B2

(12) United States Patent
Morgan et al.

(10) Patent No.: US 8,550,283 B2
(45) Date of Patent: Oct. 8, 2013

(54) LID ACTUATION SYSTEM FOR SHIELDED CASK

(75) Inventors: James W. Morgan, LaGrange, IL (US); Donald E. Preuss, Hinsdale, IL (US); Daniel M. Nestor, New Lenox, IL (US)

(73) Assignee: Uchicago Argonne, LLC, Chicago, IL (US)

( * ) Notice: Subject to any disclaimer, the term of this patent is extended or adjusted under 35 U.S.C. 154(b) by 83 days.

(21) Appl. No.: 13/205,520

(22) Filed: Aug. 8, 2011

(65) Prior Publication Data

US 2012/0037629 A1 Feb. 16, 2012

Related U.S. Application Data

(60) Provisional application No. 61/371,286, filed on Aug. 6, 2010.

(51) Int. Cl.

| | |
|---|---|
| ***B65D 17/50*** | (2006.01) |
| ***B65D 51/18*** | (2006.01) |
| ***B65D 51/04*** | (2006.01) |

(52) U.S. Cl.
USPC ..... 220/260; 220/254.6; 220/254.5

(58) Field of Classification Search
USPC ..... 588/16, 1; 49/367, 366, 116–118; 376/272; 250/506.1, 505.1; 220/827, 826, 220/822, 810, 264, 263, 260, 254.6, 254.5, 220/254.3
See application file for complete search history.

(56) References Cited

U.S. PATENT DOCUMENTS

| | | | | |
|---|---|---|---|---|
| 3,825,215 | A * | 7/1974 | Borglum | 248/147 |
| 4,825,088 | A | 4/1989 | Nair et al. | |
| 5,172,969 | A * | 12/1992 | Reuter et al. | 312/328 |
| 5,582,472 | A * | 12/1996 | Lyons et al. | 312/324 |
| 5,887,042 | A | 3/1999 | Akamatsu et al. | |
| 6,981,606 | B2 * | 1/2006 | Yang et al. | 220/23.87 |
| 7,540,396 | B2 * | 6/2009 | Yang et al. | 220/844 |
| 2008/0135555 | A1 * | 6/2008 | Watson et al. | 220/260 |

OTHER PUBLICATIONS

J.T. Bell, et al., Plutonium Polymerization-III The Nitrate Precipitation of Pu(IV Polymer, J. Inorg. Nucl. Chem, 1973, vol. 35, pp. 629-632, Pergamon Press, Great Britain.

* cited by examiner

*Primary Examiner* — J. Gregory Pickett
*Assistant Examiner* — Kaushikkumar Desai
(74) *Attorney, Agent, or Firm* — Cherskov Flaynik & Gurda, LLC

(57) ABSTRACT

A lid system for a shielding cask is provided, the system comprising a plurality of contiguous panels, each panel is axially actuated by a first lift piston located laterally from the casks' longitudinal principal axis, and rotated about the cask by a 'hinge' piston at approximately 90 degrees along an arc from the first piston, the arc formed by a portion of the lip of the cask.

10 Claims, 8 Drawing Sheets

LID ACTUATION SYSTEM FOR SHIELDED CASK

PRIORITY CLAIM

This application claims the benefits of U.S. Provisional Application filed on Aug. 6, 2010, having Ser. No. 61/371,286, the entirety of which is incorporated herein by reference.

CONTRACTUAL ORIGIN OF THE INVENTION

The United States Government has rights in this invention pursuant to Contract No. DE-AC02-06CH11357 between the United States Government and UChicago Argonne, LLC representing Argonne National Laboratory.

BACKGROUND OF THE INVENTION

1. Field of the Invention

This invention relates to the transport and storage of hazardous materials and, more specifically, to a segmented lid for a shielding cask adapted to receive radioactive or other hazardous material.

2. Background of the Invention

The nuclear and chemical industries produce large amounts of waste. The storage and transportation of these waste materials present an ever increasing challenge. Typically this waste material is stored at or near the point of production in standard size containers such as barrels that provide no shielding from radiation. Transportation for even very short distances requires encasing each container in a cask that will provide shielding.

While freshly produced reactor waste emits alpha-, beta-, and gamma-emissions, alpha emissions are very short lived. The beta rays emitted in the waste have very short path lengths but positrons emitted by the waste collide with surrounding electrons each collision producing two 0.511 MeV gamma rays as they annihilate in such a collision.

Therefore in storing or shipping radioactive waste one must shield for gamma rays, including specifically 0.511 MeV gamma rays.

The most effective shielding for gamma rays is provided by high atomic number materials (e.g. metallic lead) because of their high density. Lead also provides excellent shielding for beta rays. A lead shielded cask is suitable for the storage and transportation of a wide variety of hazardous materials.

When it is required to shield both gamma rays and neutrons, shielding comprising a mixture of lead pellets and metal hydride pellets (or another neutron absorber) is suitable. Also, metal hydride may be mixed with molten lead before lead pellets, shot, or brick are formed.

Typical shielding casks comprise a container vessel and a lid. The vessel has a stationary bottom and sidewalls containing an appropriate thickness of lead (typically 3 in.) and other shielding material. The cask must also comprise a movable lid with sufficient thickness of lead. Such a lid is very heavy. An edge of some lids is in hingeable communication with the container. This results in the lid having a large moment of inertia around that hinge with the lid swinging through a large volume of space above and alongside the vessel. At the 180 degrees point of the lid swing, the center of gravity of the combination (vessel+lid) is far removed from the center of gravity defined when the lid is in the closed configuration. This displacement of center of gravity threatens the equilibrium of the combination so as to cause tipping of the container.

SUMMARY OF THE INVENTION

An object of this invention is to provide a lid assembly for a cask for radioactive or hazardous material that overcomes many of the disadvantages in the prior art.

Another object of the invention is to provide a lid for a radioactive materials container that maintains stability of the container during actuation of the lid. A feature of the invention is that the lid is segmented in two or more complementary panels. An advantage of the invention is that segmented lid panels minimize the "arm" length of the lid, and therefore minimizes the moment the heavy lid imparts on the entire structure.

Still another object of the invention is to provide a lid assembly for a cask for radioactive or hazardous material that occupies a very small amount of space while the lid is being opened or closed. A feature of an embodiment of this invention is that the lid comprises a plurality of segments that are manipulated separately and simultaneously. An advantage of this invention is that at no time does the center of gravity of any portion of the system (i.e., bottom of the cask and the lid segments) project beyond the base plate of the system. Also at no time does any part of the system protrude more than half-a-width of the lid beyond the periphery of the cask.

A further object of the invention is to provide a lid assembly for a cask for radioactive or hazardous material such that when opening or closing the lid the center of gravity of the whole system (i.e., the bottom of the cask plus the lid components) varies only slightly through the entire range of motion of the system. A feature of this invention is the minimization of the arm (and therefore a minimization of the moment) of the motion, which is achieved by simultaneously moving segmented lid components. An advantage of this invention is that the horizontal center of gravity of the whole system remains substantially unchanged. In one embodiment, the CG shift is within one fiftieth of the width of the lid. This provides optimum stability for the system.

In brief, the present invention provides a lid for a shielding cask having a bottom, said lid comprising: a plurality of contiguous panels, each panel axially actuated by a first lift piston located proximally to a panel's principal axis, and rotated about the half-lid's center of gravity by a 'hinge' piston located laterally from said first piston.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION OF THE INVENTION

Figure 1:
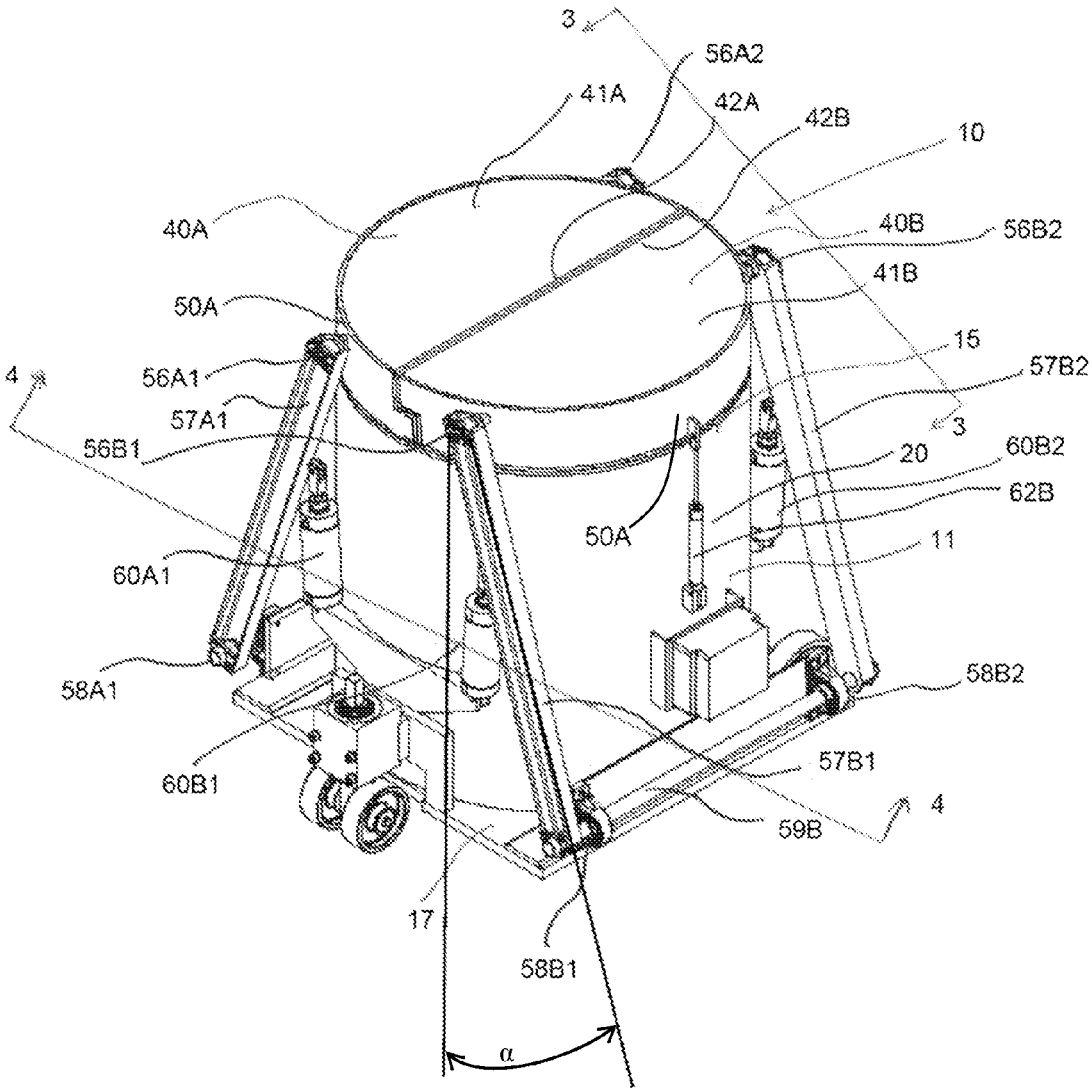
FIG. 1 is a perspective view of a shielding cask and lid, in accordance with features of the present invention.

The present invention introduces a compact segmented lid assembly for a shielding cask used to store and transport radioactive and hazardous materials. This assembly minimizes any disruption of the center of gravity of the lid-container configuration, so as to prevent tipping.

An embodiment of the present invention provides a drum encapsulation system comprising a full bottom enclosure and a open top, the top mating with a plurality of lid panels. At no time during the operation of the system does any component of it extend beyond the base plate of the system.

In another embodiment of the system, at no time when lid-opening and closing operations are carried out does any part of the system extend above the periphery of the cask beyond half-a-width of the lid.

In an embodiment of the lid-actuation system, the lids project past the periphery of the horizontally disposed base plate of the cask. It is not possible for the CG of any component to project beyond the base plate. This despite the fact that the baseplate is minimized to reduce the footprint while the cask was being moved.

An embodiment of the system allows for the CG of the assembly and all components to remain within the periphery of the assembly.

In one embodiment of the invention, the lid projects laterally past the periphery of the baseplate of the cask, to afford as wide a mouth opening as possible. However, this configuration prevents the center of gravity of any component of the invented lid actuation system to project laterally beyond the periphery of the baseplate. Generally, the center of gravity is shifted a distance of between approximately $1/50^{th}$ and $1/25^{th}$ of the diameter of the lid.

The lid comprises a plurality of contiguous panels, opposite sides of each panel rotatably linked to the bottom of the cask by actuator arms. A first superior end of each arm attaches to one of two points on the panel, those two points defining a chord line extending approximately perpendicular to the longitudinal axis of the cask. A second, depending end of each piston is rotatably attached to a base of the unit such that the piston is situated at an angle $\alpha$ to a line parallel to the longitudinal axis of the cask.

A compressed air 'hinge' piston positioned on the periphery of the cask and between said lift pistons, is also provided.

In an embodiment of the invention, the shape of the container, and therefore of the cask, is dictated by the shape of the materials to be transported. For instance, if these materials destined for encapsulation are rectangular bricks of length L and width W, a reasonable choice for the container would be a structure with an approximately square horizontal cross-section of dimensions lL by wW (l, w being integers). Where the materials to be transported are liquids or solids of arbitrary shape, the invented cask is adapted to encapsulate or otherwise slidably receive a typical 55 gallon barrel. For the sake of illustration, the sequestered container depicted herein is a 55-gallon open top steel drum and the waste considered is radioactive.

FIG. 1 is a perspective view of an exemplary embodiment of a cask 10 comprising an invented lid assembly 15 and a lower container part 11. FIG. 1 shows a plurality (e.g. a pair) of lift assemblies comprising actuator arms 57 and pistons 60 for each segment of the lid. Each of the assemblies are positioned on opposite sides of the lower container part 11 to facilitate even opening and closing of the lid segments. (A lid with three or more segments is also envisioned.) If the lid comprises two panels, the longest dimension of the lid perpendicular to the line of segmentation will be designated "the width of the lid." For a circular lid, its width is the diameter of the circle defining the shape of the lid.

Figure 2:
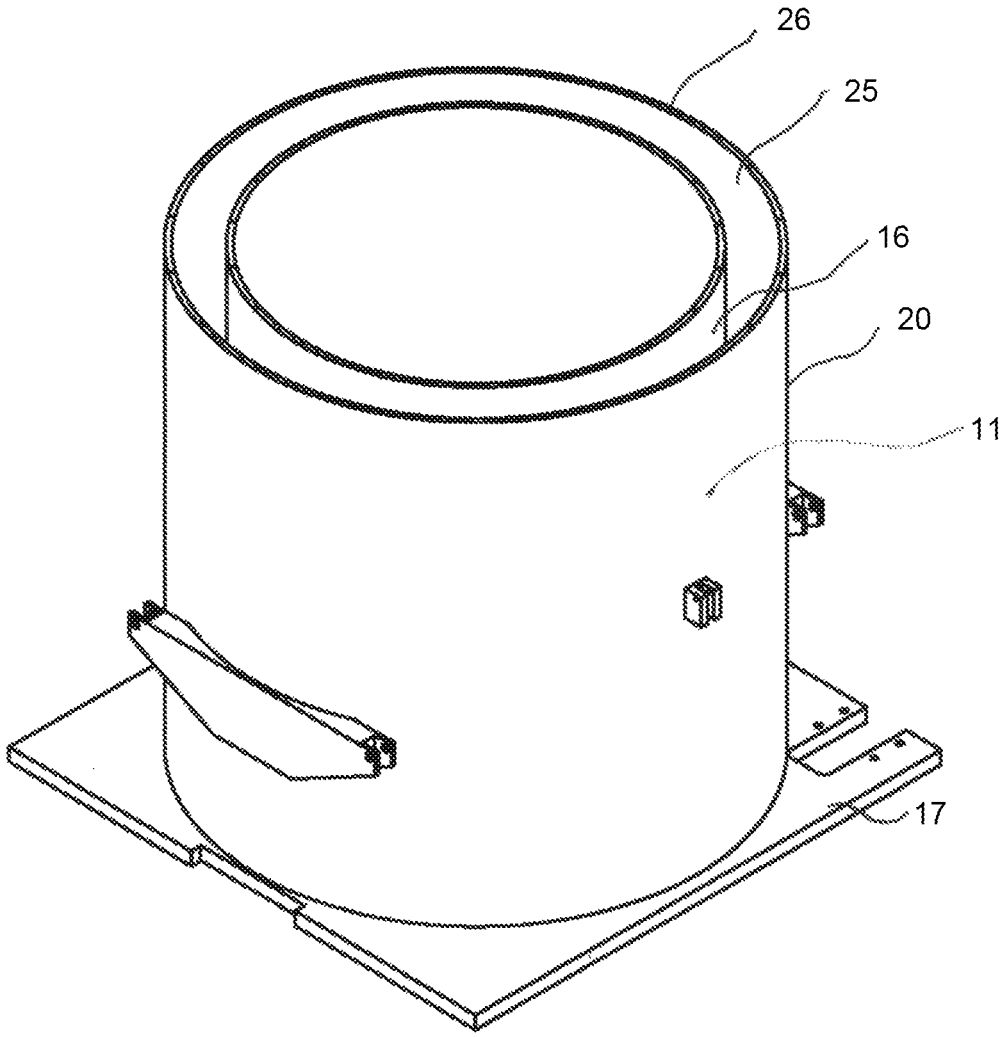
FIG. 2 is a profile view of the bottom portion of the cask shown in FIG. 1, in accordance with features of the present invention.

FIG. 2 is a perspective view of the lower container part 11 of the cask 10. As shown in FIG. 2, the lower container part 11 of the cask 10 comprises an inner cylindrical vertical wall 16 and an outer cylindrical vertical wall 20, coaxial to the inner wall 16, such that the outer cylindrical vertical wall is radially displaced from the inner wall. The walls 16 and 20 are welded or otherwise rigidly affixed to a base plate 17. So positioned, the walls 16 and 20 define an annular gap 25, positioned intermediate the walls and which is adapted to receive radiation absorbing material such as lead shot, or a mixture of radiation and neutron shielding material. In an exemplary embodiment, the gap 25 is 3.0 in wide. The inner cylindrical wall 16 defines a space, the cross section of which is complementary to the size and shape of a typical storage container. The illustrated embodiment shows the space adapted to slidably receive a typical sized drum, such as a 42- or a 55-gallon drum. An annular plate (not shown) seals the gap 25.

In an embodiment of the invention, the walls 16 and 20 are such that the top of the drum protrudes above the lip 26 of the outer wall 20 so as to facilitate grasping and lifting of the drum once the lid 15 of the drum encapsulation system is removed or otherwise decoupled from the lip of the cask. In an embodiment, the cask allows for the drum to protrude approximately 2" above the lip 26.

Lid Assembly Detail

Figure 3:
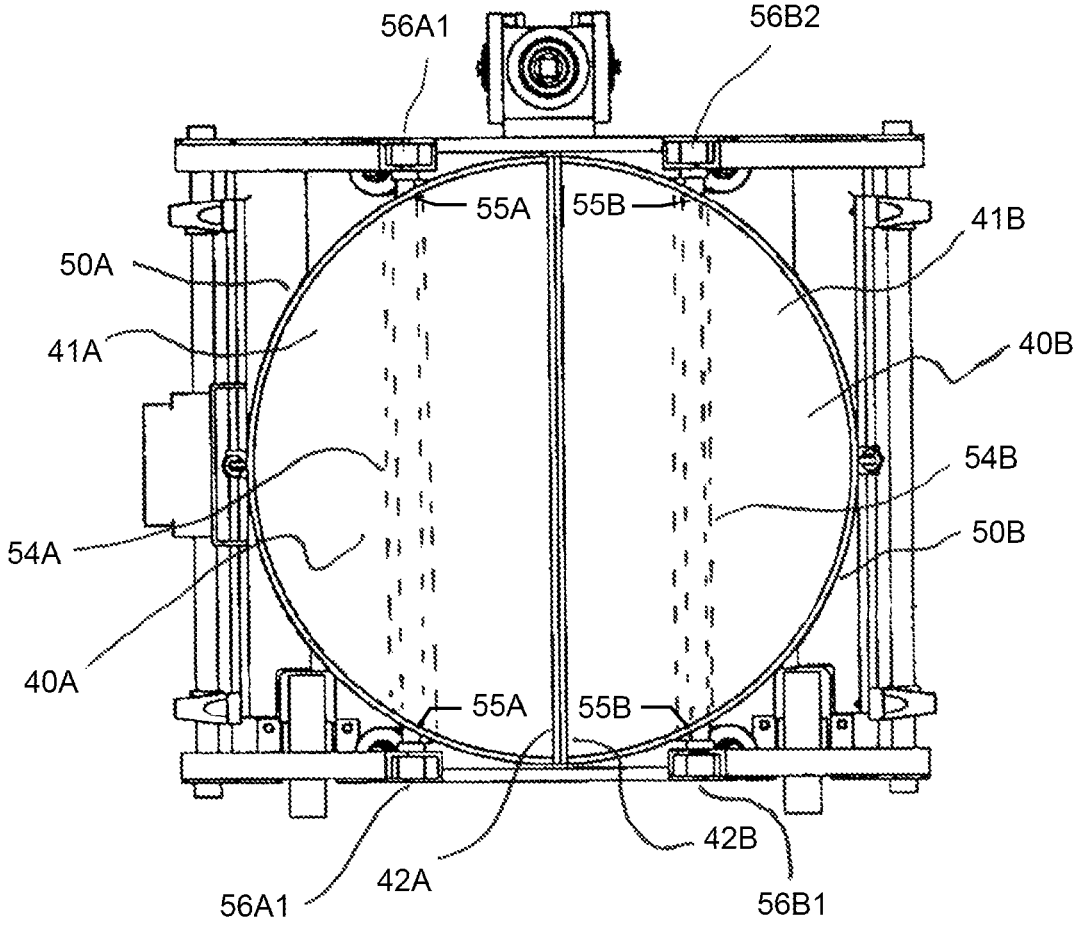
FIG. 3 is a top view of FIG. 1 along the line 3-3.
Figure 4:
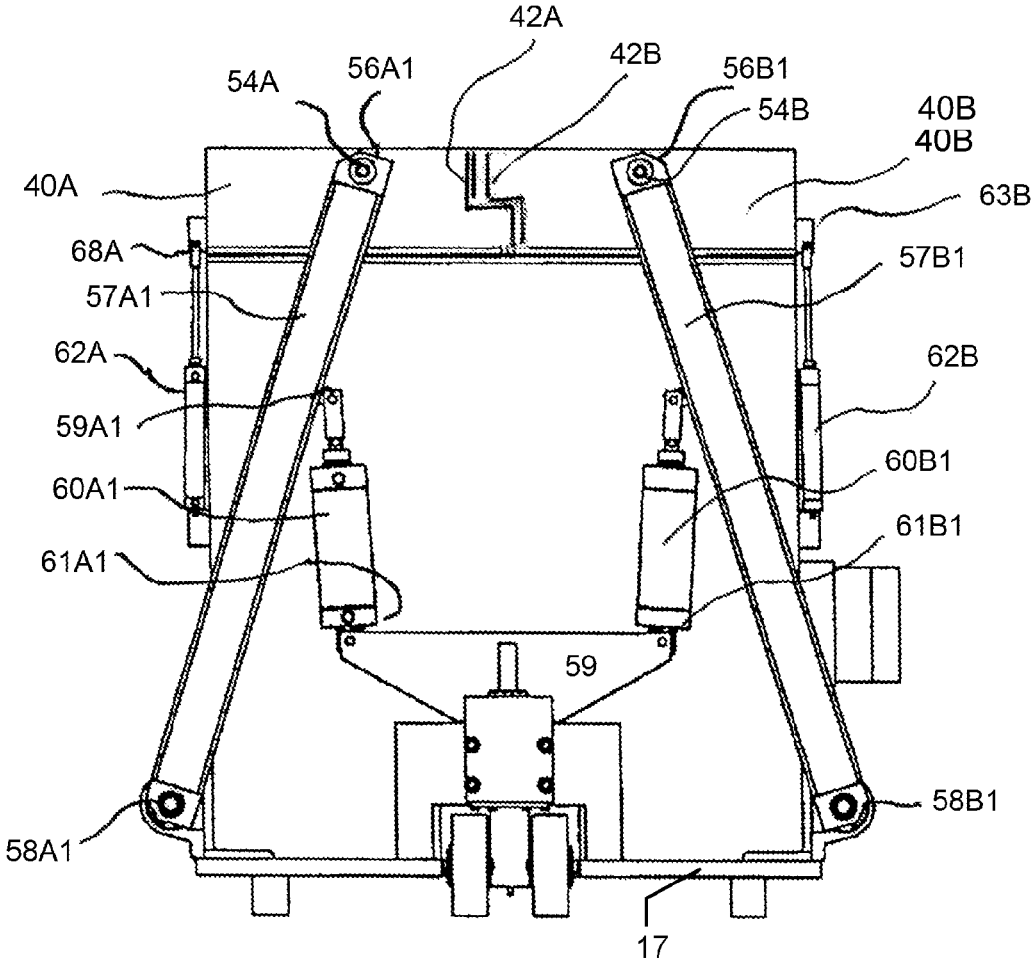
FIG. 4 is a side view of FIG. 1 along line 4-4.

As shown in FIG. 1, the cylindrical wall 20 supports the lid assembly 10 when the cask is closed. FIG. 3 is a top view of FIG. 1 taken along line 3-3 and FIG. 4 is a profile view of FIG. 1 taken along line 4-4. As shown in FIG. 3 the lid assembly comprises two half-circular panels 40A, 40B that form a cover for the cask 15. The panels 40A, 40B are independently articulated as described infra. In one embodiment of the invention, these two panels are hollow so that they can be filled with lead shot or other radiation shielding material. In an alternative embodiment, these panels each comprise a reinforced lead plate.

Each panel 40A, 40B, comprises a horizontal cap plate 41A, 41B in the form of half-a-circle such that each cap plate defines an arc which lies in registration with half of the circular periphery of the lower container portion 11. The remaining periphery of each panel terminates in a cord line 42A, 42B, so as to lie in registration with a latitudinally extending midline of the lower container portion 11. The cord line of one horizontal cap plate opposes the cord line of the other horizontal cap plate. As such, the two panels meet at the cord line edges 42A, 42B and define a diameter of the circle formed by the cask outer wall 20. As shown in FIGS. 1 and 4 the edges 42A, 42B form overlapping steps so that there is no straight line path from the interior of the bottom 11 to the surrounding environs. Alternatively, the edges are continuous and without angles or step design.

Integrally formed with the circular periphery portion of each cap plate is a perpendicularly extending skirt 50A, 50B which terminates in a depending lip. Each lip opposes the cask outer wall so as to form a continuous surface with the outer wall.

Figure 7:
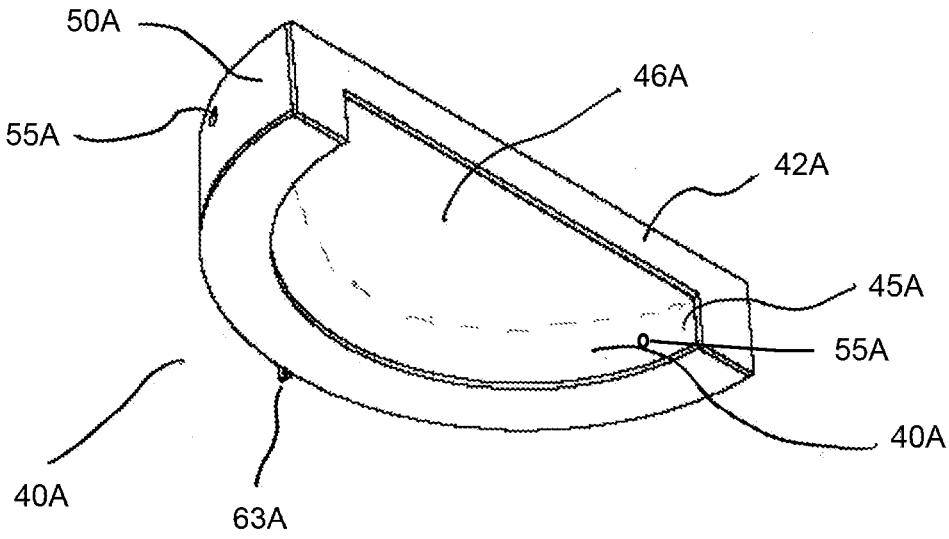
FIG. 7 is a perspective view of a lid panel according to features of the present invention.

FIG. 7 presents a perspective view of a panel. As shown in FIG. 7, each panel has an inner vertical cylindrical wall 45A, 45B so as to be continuous with inwardly facing wall of the cask inner cylinder 16. Each panel further comprises an inner horizontal half-circular plate 46A, 46B, which is axially displaced and also radially displaced inward (i.e., toward the longitudinal axis of the cask) from its counterpart outer horizontal half-circular plate 41A, 41B by about 2-3 inches. The axial displacement results in a disk-shaped void between counterpart plates of about 2 to 3 inches in depth. This void or space intermediate the plates 41A and 46A (or 41B and 46B) may be filled with lead shot or other shielding material.

Figure 5:
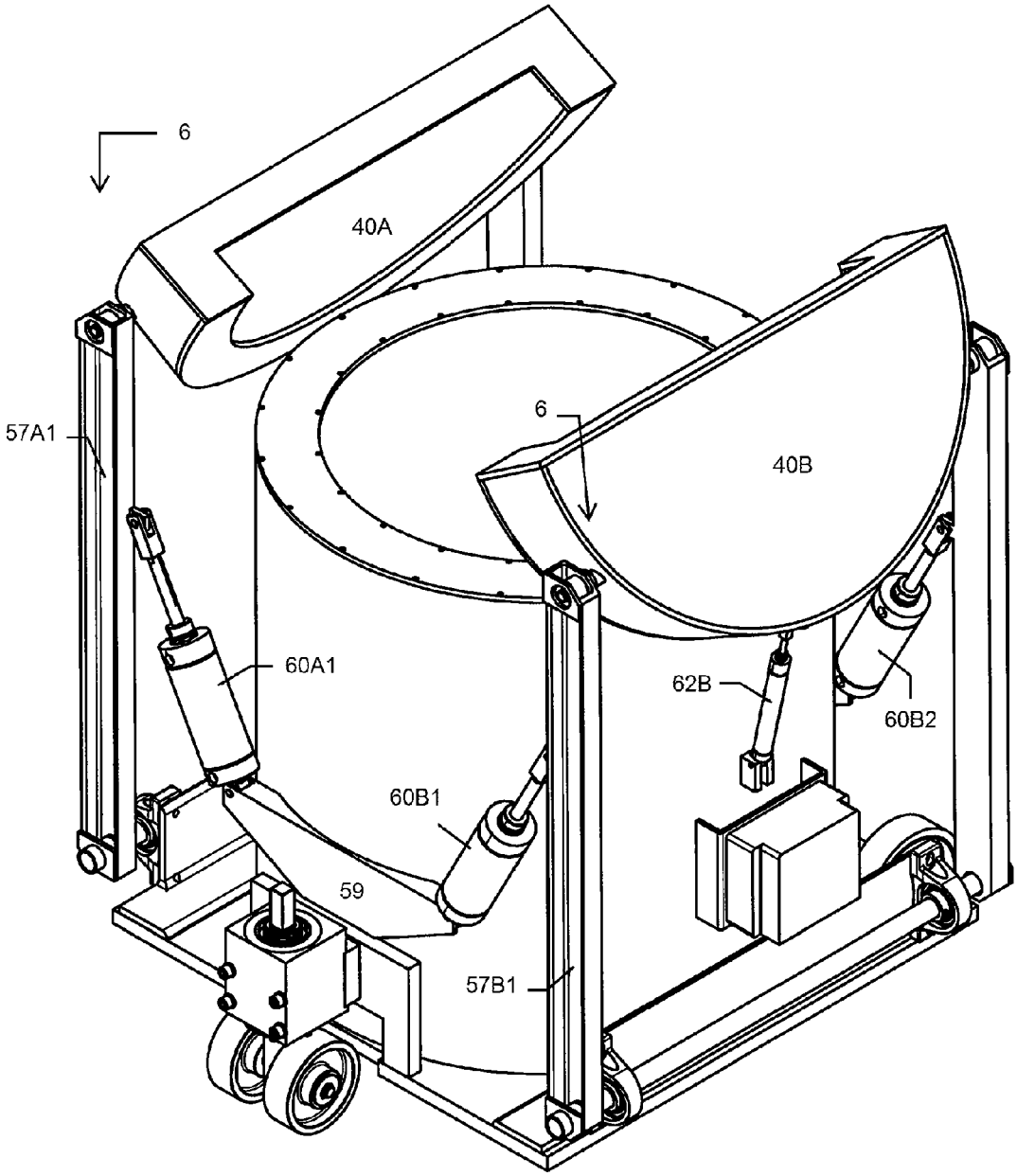
FIG. 5 is a perspective view of an embodiment of the invented cask, with its lids in an open configuration, in accordance with features of the present invention.

As depicted in FIGS. 3 and 5, regions of the vertically extending skirt of each lid define bores 55A, 55B, adapted to receive horizontally disposed rods 54A, 54B. Ball bearings 56A1, 56A2 attached to the ends of rod 54A proximal to the bore 55A and bearings 56B1, 56B2 attached to the ends of rod 54B proximal to the bore 55B facilitate rotatable communication of these rods with the aforementioned actuator arms. In the alternative, the bearings 56 are adapted to be received in channel ways formed in the regions of the walls 50A, 50B defining the bores 55A, 55B, said channel-ways defining surfaces in direct opposition to the rods inserted there through so that the ball bearings contact the rods to minimize rotational friction between the walls and the rods.

For each panel, the rod 54 or the line defined by a pair of bearings 56 is parallel to the panel's cord edge 42 so as to lie in the same vertical plane as the center of gravity of the panel. (For a uniform panel, the rod or the line defined by the bearings is co-linear with the center of gravity). In other words, the rod 54 is substantially co-linear to, or in close spatial relation to, the principal axis of the panel parallel to the edge. The second ends 66 of the downwardly directed and laterally extending actuator arms 57A1, 57B1 link each of the bearings 56A1, 56B1 to bearings 58A1, 58B1 affixed to the base plate 17. The beams are linked by a horizontally disposed beam 59 disposed approximately perpendicular to and between the extending beams 57A1 and 57B1, such that the beam 59 is in close spatial relation to the base plate 17 of the system.

One end (in this case a superior end) of a "lift" piston 60A1 is pivotally attached to a point of the beam 57A1 intermediate the beam's ends while a second end (in this case the depending end) of the lift piston 60A1 is fixed to a first end of the horizontally displaced beam 59. A second lift piston 60B1 is similarly attached to the beam 57B1. A cylinder of a first "hinge piston-cylinder" 62A is pivotally attached to the cask wall 20 while the piston means of the hinge piston cylinder 62 is rotatably attached to a laterally facing peripheral region of the lid, and to the lid wall 50A at a point 63A intermediate the two bearings 56A1, 56A2. The same applies to a second hinge piston 62B.

Operation of the Invented Lid Assembly

Figure 6:
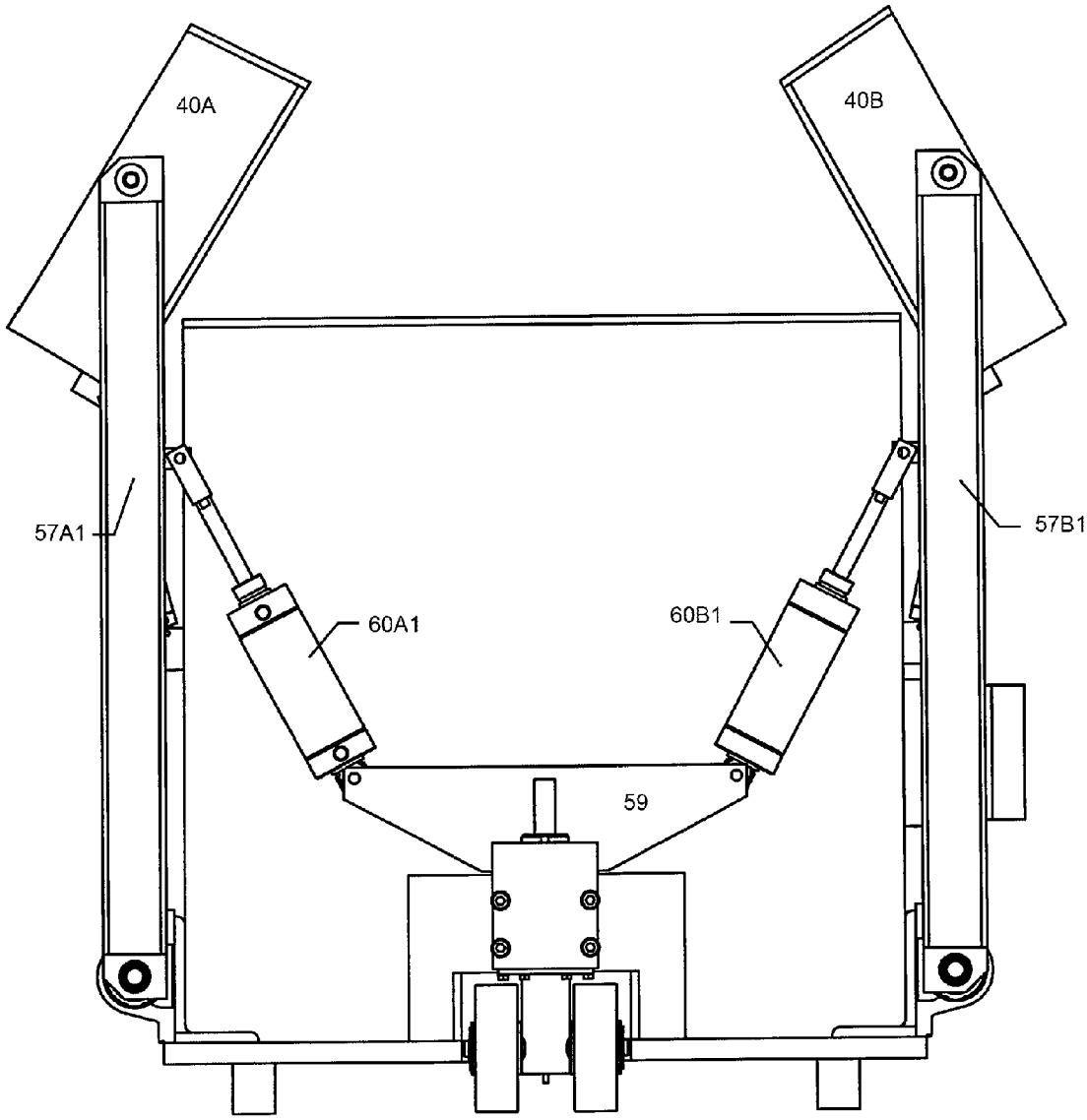
FIG. 6 is a view of FIG. 5 taken along line 6-6.

Operation of the invented lid assembly can best be described by initial reference to FIGS. 1, 3 and 4 which show the lid assembly in a "closed" configuration. FIGS. 5 and 6 depict the lid assembly in an "open" configuration. Opening and closure of the lid assembly is monitored visually by an operator who controls a compressed fluid provided to the pistons. In one embodiment of the invention, as shown in FIG. 4, an overlapping panel, i.e. 40B, must be lifted first a small amount, roughly equal to half the height of the panel depth 50A, 50B, such lifting being effected by applying compressed fluid (such as compressed gas) to the pistons 60B1, 62B. Once the panels are disengaged, high-pressure air is applied simultaneously to substantially all lifting pistons (such as those pistons 60A1, 62A, 60B1, 62B depicted). As these pistons progress to their maximum extension, the bearings 56 describe a circular arc simultaneous with the "hinge pistons" 62A, 62B exert a downward force on each of the panels. (The fact that the bearings 56 are substantially aligned with the center of gravity of the respective panels results in that only a minimal force need be exerted by the hinge pistons 62A, 62B in order to rotate the panels).

In another lid lifting process, air is first applied to lifting piston 60A1, and its lifting piston counterpart 60A2 of one lid segment and lifting piston 60B1 and its lifting piston counterpart 60B2 to lift their respective lid halves off of the upper periphery of the cylinder 11. The hinge piston 62A remains extended until the lid is about 2" above the container 11, then is retracted, pivoting the lid. The lifting pistons 60A1, 60A2, 60B1, 60B2 are controlled from one switch while the hinge pistons 62A, 62B are controlled from another switch.

Figure 8:
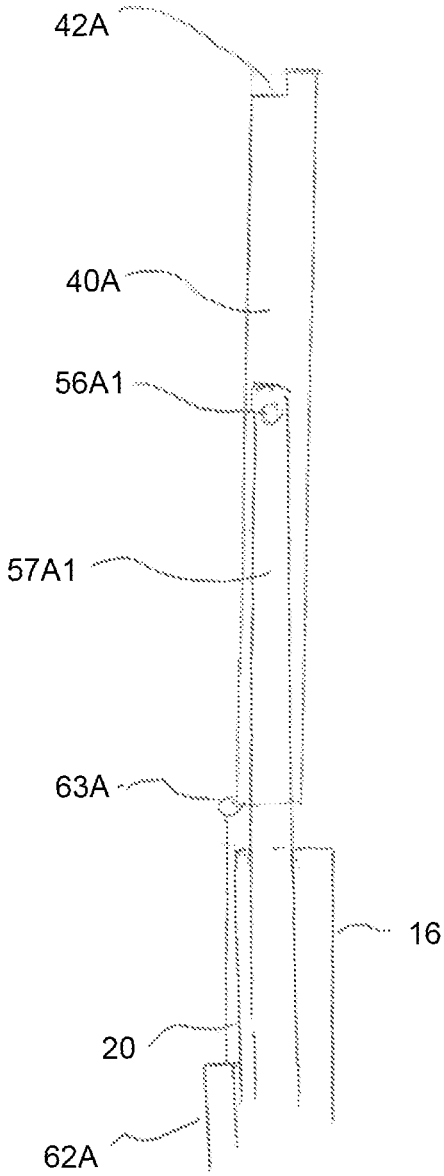
FIG. 8 is an enlarged cross-sectional view of a portion of a lid panel in an open position according to features of this invention.

As shown in FIG. 8, when the pistons 60 reach their maximum extension the hinge point 63A, the bearings 56A1 and 56A2, and the panel edge 42A all lie substantially in the same vertically disposed plane, with no portion of the lid vertically aligned with the inner cask wall 16. (The piston 62B imparts a mirror-image motion to the panel 40B). Closing the lid assembly is effected by reverse operations to those described supra, with the two panels being brought out simultaneously but with care being taken that panel 40A contact the cask periphery 26 first.

The above method of opening and closing the lid ensures that during these operations the horizontal position of the center of gravity of the whole system (e.g. bottom 11 of the cask, a first lid panel 40A and a second lid panel 40B) remains unchanged to within about one fiftieth of the diameter of the cask bottom 11. This provides optimal stability for the system. Also, these operations are carried out in such a manner that at no time a portion of the system laterally projects beyond the base plate 17. Moreover, the system is such that at no time when these operations are carried out does any part of the system protrude above the periphery 26 of the cask higher than the radius of the cask bottom 11.

Additional Embodiments

The embodiment described supra can be modified in several ways. One modification is to have a rectangular or oval lid segmented along the axis with the smallest moment of inertia. Then the bearings 56 for the lift pistons 60 will be located at the ends of a panel's principal axis that is parallel to the segmentation line and the hinge pistons 62 will be attached to the lid points furthest away from the segmentation line.

The same methods can be applied to lids of different shapes that are divided in two segments and to lids with three or more segments. In every case the bearings 56 must be placed near a principal axis of the lid and the hinge pistons at a point with the largest perpendicular distance from a principal axis.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

The invention claimed is:

1. A lid actuating system for the storage of hazardous materials said system comprising:

a) a cask having a bottom, a lip defining an open top, wherein the cask defines a longitudinal axis;

b) a lid comprising a plurality of contiguous panels, the lid having a shape complementary to a cross section of the lip of the cask wherein the lid projects laterally past the bottom when opened;

c) at least two actuator arms for each panel such that a first end of each actuator arm is rotatably attached to the panel and a second end of each actuator arm is rotatably attached to a base plate supporting the bottom of the cask, the actuator arms located laterally from the longitudinal axis of the cask;

d) a lift piston with a first end of the lift piston in rotatable communication with one of said two actuator arms and a second end of the lift piston in rotatable communication with the cask;

e) a hinge piston positioned intermediate said two actuator arms and rotatably attached to a laterally facing peripheral region of the lid; and f) a cylinder adapted to receive said hinge piston, said cylinder pivotally attached to an outer vertical wall of the cask.

2. The system as a recited in claim 1 wherein the lift pistons are acted upon simultaneously when said panels are disengaged from each other.

3. The system as recited in claim 2 wherein said bottom and said panels each have a center of gravity such that the center of gravity in a horizontal plane of the sum of the bottom and the panels varies between about 1/50th to 1/25th of a diameter of the lid while said lid is opened or closed.

4. The system as recited in claim 1 wherein no portion of the lid protrudes above the cask top more than the radius of the cask.

5. The system as recited in claim 1 wherein no portion of the lid protrudes a distance beyond the outer surface of the cask wall more than a thickness of the lid.

6. The system as recited in claim 1 wherein no portion of said lid overhangs inside vertical surfaces of the cask when said lid is fully deployed.

7. The system as recited in claim 1 in the lid remains in pivotal communication with the cask when the lid is fully deployed.

8. The system as recited in claim 1 wherein the lid comprises two contiguous panels and opposing edges of the panels form a multiplanar interface.

9. The system as recited in claim 1 wherein the cask is adapted to receive a drum and an upwardly extending lip of the drum protrudes above the lip of the cask when the drum is received by the cask.

10. The system as recited in claim 9 wherein the drum is substantially encased by the cask when the lid is received by the lip of the cask.

* * * * *